US005340456A

United States Patent [19]

Mehler

[11] Patent Number: 5,340,456

[45] Date of Patent: Aug. 23, 1994

[54] ANODE BASKET

[76] Inventor: Vern A. Mehler, 18030 Bariger, South Bend, Ind. 46637

[21] Appl. No.: 37,337

[22] Filed: Mar. 26, 1993

[51] Int. Cl.[5] ..... C25D 17/00

[52] U.S. Cl. ..... 204/242; 204/285; 204/287

[58] Field of Search ..... 204/242, 284, 280, 285, 204/287

[56] References Cited

U.S. PATENT DOCUMENTS

| | | | |
|---|---|---|---|
| 4,381,982 | 5/1983 | Metzger | 204/272 |
| 5,032,245 | 7/1991 | Gemelli et al. | 204/284 |
| 5,120,409 | 6/1992 | Hanulik | 204/105 R |

*Primary Examiner*—Kathryn Gorgos
*Attorney, Agent, or Firm*—James D. Hall

[57] ABSTRACT

An anode basket for use in electroplating operations. The anode basket is formed of a pliant, shape-returning material which acts as a spring to ensure contact between the plating metal and the anode. The basket may be formed of a non-conductive plastic and the anode from corrosion-resistant conductive metal.

12 Claims, 2 Drawing Sheets

ANODE BASKET

FIELD OF THE INVENTION

This invention relates to electroplating and will have special application to improvements in anode baskets used in electroplating operations.

BACKGROUND OF THE INVENTION

Current anodic electroplating operations utilize a metal anode bar supported above or suspended in a tank of the plating solution. An anode basket formed of an electrically conductive metal is suspended from and otherwise connected to the bar and is submerged in the plating solution. Anode metal is placed in the anode basket and is dissolved and ionized by the charged solution to give off positive metal ions. The ions are plated as solid metal onto the material to be plated at the cathode.

U.S. Pat. No. 4,610,773 to Takayuso teaches forming the anode bar and anode basket with a protective outer covering of a corrosion resistant metal, such as titanium. Forming the anode bar and basket in that fashion reduced but doesn't eliminate the problems of sparking, pitting, hot spots, burning, contact cleaning, and a host of other problems associated with electrical conductivity in an electroplating operation.

Other methods have been previously used to combat the corrosion problem, but none of the prior methods exhibit an efficient and economical system which can be reused with minimal cleaning. Another serious problem with previously used metal anode baskets was the non-elasticity of the basket. As anode metal in the basket dissolves, the anode metal pieces become smaller until they are no longer provide good electrical contact with the conductive basket.

SUMMARY OF THE INVENTION

The anode basket of this invention is formed to greatly reduce the problems inherent with prior art metal anode baskets. The basket is formed of a shape-returning material which ensures that the anode metal placed in the basket remains in direct contact with the conductive grid at substantially all times during plating operations. The anode basket is preferably shaped in a wedge sock-like fashion to allow the shape-returning material to urge the anode metal into contact with the conductive metal grid.

The grid is positioned inside the basket and is connected by conductive wire to the bus duct. The connection of the wire to the grid is preferably submerged in the plating solution and the wire itself is covered by insulative material to prevent intrusion of the plating solution. The basket and grid are suspended in the tank and are supported by an anode bar and an anode basket hanger.

Accordingly, it is an object of this invention to provide for an improved anode basket.

Another object is to provide for an anode basket which enhances the rate at which the anode metal is dissolved and ionized during plating.

Another object is to provide for an anode basket which exhibits superior electrical conductivity and eliminates electrical arcing and burning.

Another object is to provide for an anode basket which eliminates the need to clean electrical contact points.

Other objects will become apparent upon a reading of the following description.

BRIEF DESCRIPTION OF THE DRAWINGS

A preferred embodiment has been depicted for illustrative purposes only wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to follow its teachings.

Figure 4:
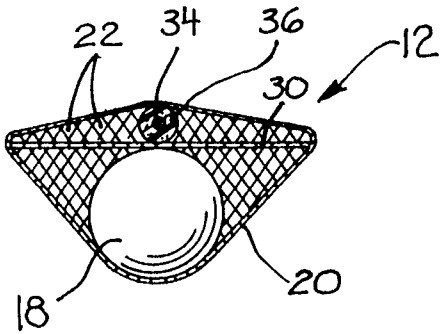
FIG. 4 is a cross-sectional view taken along line 4—4 of FIG. 3.
Figure 3:
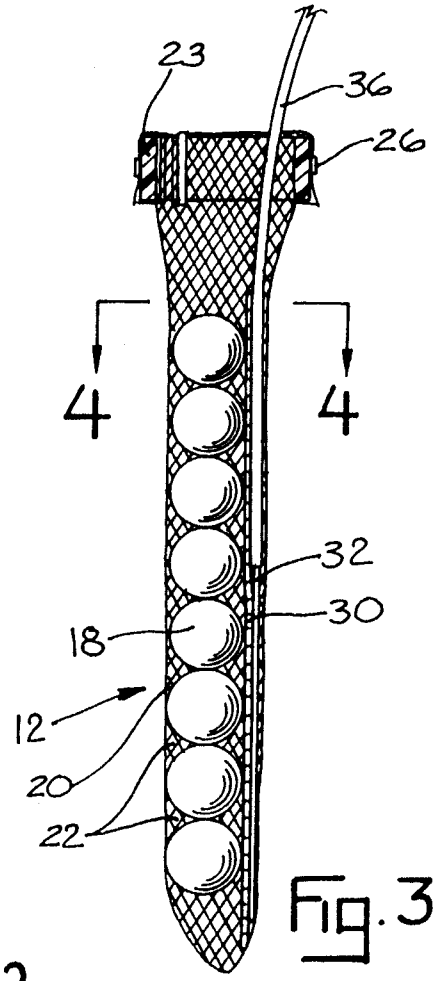
FIG. 3 is a sectional view taken along line 3—3 of FIG. 2.
Figure 2:
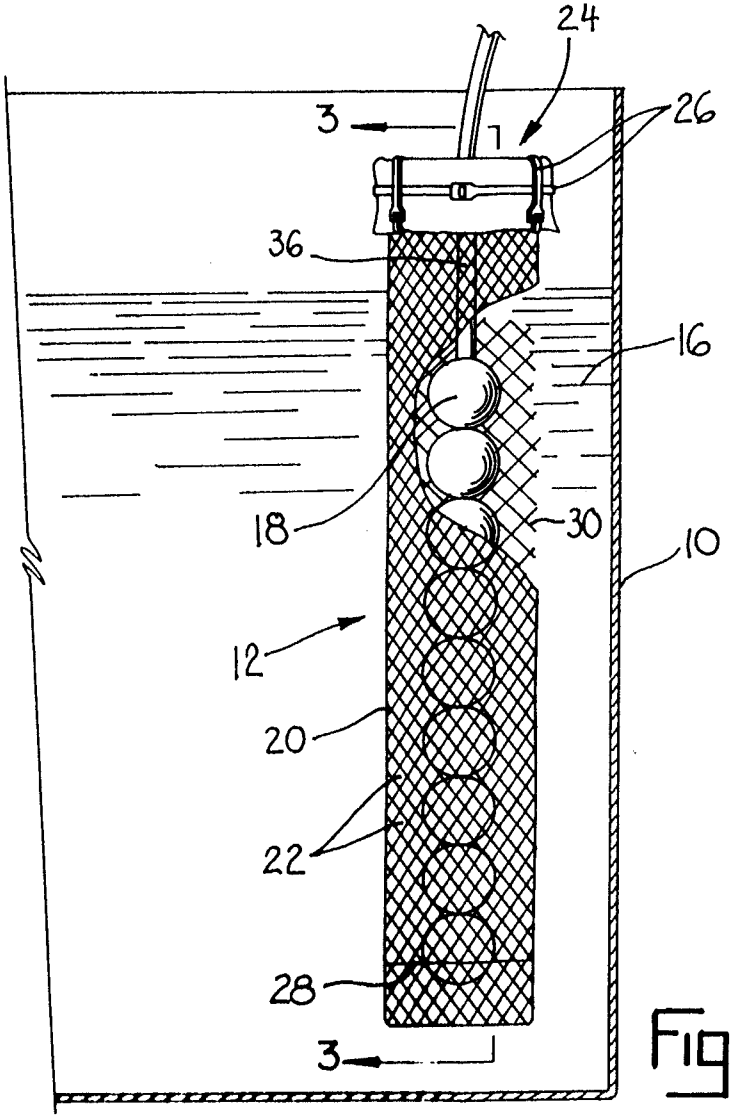
FIG. 2 is a fragmented elevation view of an electroplating tank utilizing the anode basket of this invention in operation.

Referring to the FIGS. 2–4 reference numeral 10 refers generally to an electroplating tank which utilizes the improved anode basket 12 of this invention. Electroplating tank 10 includes a conventional tank which is filled with plating solution 16, typically an aqueous metal salt solution. The most common plating metals are copper and zinc, with solution 16 comprised of copper or zinc ions, but any suitable plating metals may be used. Solution 16 is typically an aqueous salt of the metal being plated.

Anode basket 12 carries the solid metal anode material 18 which is dissolved and deposited upon a material to be plated at the cathode (not shown). As shown, anode basket 12 includes an open mesh sock 20 which is formed from a pliant, shape-returning material and defines a plurality of apertures 22. Suitable materials for sock 20 are polyethylene, propylene and polyvinyl chloride, among others.

Figure 1:
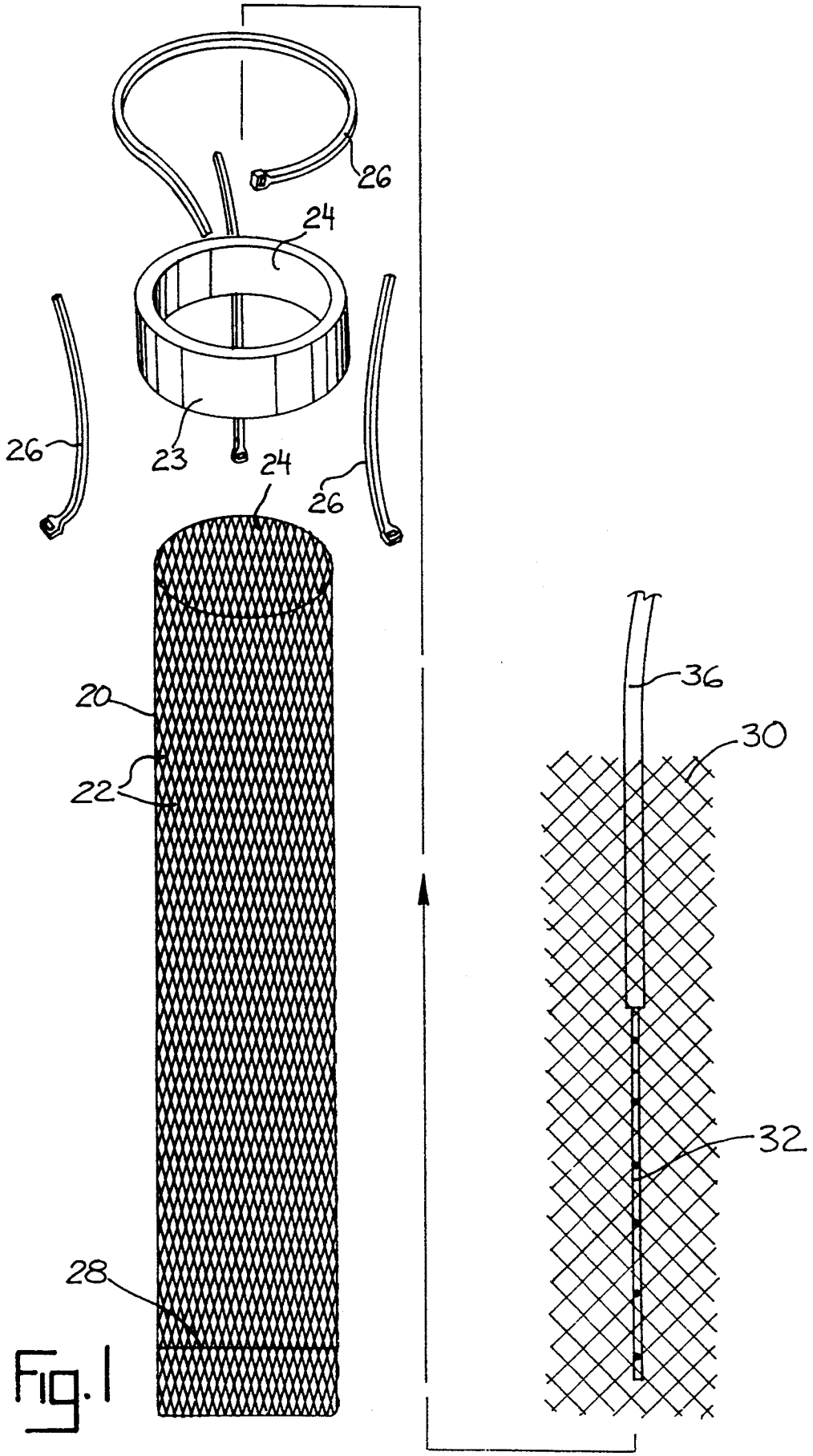
FIG. 1 is an exploded view of the anode basket of this invention.

As shown in FIG. 1, sock 20 is preferably of a generally cylindrical shape and typically resembles a closed end cylinder. Annular support 23 formed of a rigid plastic defines an upper insertion opening 24 through which anode metal 18 may be deposited into sock 20. Support 23 is connected to sock 20 as by tie fasteners 26. The other end of sock 20 is closed as by stitching 28 to prevent anode metal 18 from exiting basket 12. (See Fig. 2)

Electrical contact grid 30 is removably fitted in sock 20. Grid 30 is preferably formed of an open mesh, non-corrosive metal such as titanium or equivalent metal which possesses good salt corrosion properties.

A titanium rod 32 in FIG. 1 is connected, as by welding, to grid 30, to form a complete anode electrode. In FIG. 4, conductive metal wire 34, normally of copper, is connected to rod 32. Electrically insulative material 36 covers and surrounds wire 34 and prevents solution contact with the wire. Wire 34 is connected to a bus bar (not shown) of common construction which supplies the raw electrical current.

FIG. 2 illustrates anode basket 12 in use with electroplating tank 10. Basket 12 is filled with solid plating metal 18, shown as zinc balls. Basket 12 is suspended from a common support bar (not shown) by hanger (not shown) such that metal 18 is submerged. Preferably, the junction of rod 32 and insulation 36 is also submerged in the solution 16. Wire 34 is connected to the power bus (not shown) and the electric current is switched on. The cathode (not shown) is also connected to the power bus to complete the electrolytic circuit.

As in a typical electroplating operation, negatively charged electrons flow from the cathode through the solution 16 to the anode 30 and 32. Anode metal 18 contained in basket 12 and in contact with anode grid 30 is dissolved and the positive ions enter the plating solution 16 where they flow toward the cathode. The positive ions (in the example given, $Zn^+$ ions) meeting the negative electrons at the cathode cause the reduction of the aqueous ions to solid metal which is deposited on the cathode. This process is well understood by those skilled in the art.

Anode metal 18 dissolves into the solution 16 during plating operations. The shape-returning properties of sock 20 act as a sort of spring to keep the ever-decreasing mass of anode metal 18 in contact with grid 30. This allows for maximum conductivity at all times by reducing resistance and the elimination of intermittent contact between anode metal 18 and grid 30. Forming grid 30 and anode 32 of titanium or other corrosion-resistant metal obviates the need for periodic electrode cleaning.

Further, the positioning of the insulated wire 34 below the surface of solution 16 allows the solution to cool the contact point between the wire 34 and the grid 30. This increases the electrical current flow through the solution, and provides for faster, more efficient plating of the anode metal 18. Because of this more efficient operation, fewer anode baskets 12 can be used in each tank 14 and the need for adding dissolved plating metal to the solution is greatly reduced and in some cases eliminated altogether.

It is understood that the above description does not limit the invention to the precise details disclosed above, and that it may be modified within the scope of the following claims.

I claim:

1. In an apparatus for electroplating metal including a solution tank filled with electroplating solution, and an anode basket having an anode therein is suspended from said tank and submerged in said solution, the improvement wherein said anode includes a conductive corrosion resistant member housed inside said anode basket, means for connecting said member directly to an electric power source, a conductive grid housed in said anode basket and in direct contact with said anode and submerged in said solution, means for connecting said member to said grid.

2. Apparatus of claim 1 wherein said anode basket is formed of an electrically non-conductive plastic material.

3. Apparatus of claim 2 wherein said plastic material is polyethylene, polypropylene or polyvinyl chloride.

4. Apparatus of claim 2 wherein said anode includes an electrically conductive corrosion-resistant rod housed in said anode basket.

5. Apparatus of claim 4 wherein said grid is formed of corrosion resistant-metal fixedly connected to said rod.

6. Apparatus of claim 4 and insulated wire means connected to said rod for establishing electrical continuity between the rod and a power source.

7. Apparatus of claim 6 wherein said wire means is connected to said rod at a point submerged in said plating solution.

8. Apparatus of claim 7 and hanger means for supporting said basket in said solution.

9. Apparatus of claim 1 wherein said anode basket includes first and second ends, means carried at said first end for defining an opening through which plating metal is inserted into said basket, means for closing said second end to prevent escape of said plating metal from said basket.

10. Apparatus of claim 9 wherein said basket is generally cylindrical and tapers gradually from said open first end to said closed second end.

11. Apparatus of claim 7 wherein said anode basket is formed of pliant shape-returning material, which urges said plating metal into continuous direct electrical contact with said grid.

12. Apparatus of claim 1 wherein said anode basket is formed of pliant shape-retaining material which urges plating metal into continuous direct electrical contact with said grid when said plating metal is placed within said anode basket.

* * * * *